US006266019B1

(12) United States Patent
Stewart et al.

(10) Patent No.: US 6,266,019 B1
(45) Date of Patent: Jul. 24, 2001

(54) SYSTEM FOR INCREASING ANTENNA EFFICIENCY

(75) Inventors: William Paul Stewart, Mebane; Randy D. Hickle, Apex, both of NC (US)

(73) Assignee: Ericsson Inc., Research Triangle Park, NC (US)

( * ) Notice: Subject to any disclaimer, the term of this patent is extended or adjusted under 35 U.S.C. 154(b) by 0 days.

(21) Appl. No.: 09/621,392

(22) Filed: Jul. 21, 2000

(51) Int. Cl.[7] ..... H01Q 1/24
(52) U.S. Cl. ..... 343/702; 455/40
(58) Field of Search ..... 343/702, 749; 455/90

(56) References Cited

U.S. PATENT DOCUMENTS 5,020,136 * 5/1991 Patsiokas et al. ..... 455/89
5,606,733 * 2/1997 Kanayama et al. ..... 455/89
5,977,917 * 11/1999 Hirose ..... 343/702

* cited by examiner

*Primary Examiner*—Don Wong
*Assistant Examiner*—Huang Nguyen
(74) *Attorney, Agent, or Firm*—Wood, Phillips, VanSanten, Clark & Mortimer

(57) ABSTRACT

A communications device having an antenna and a housing having a front section and a rear section, one of the front section and the rear section being conductive. A circuit board is mounted within the housing and includes a point of lowest potential and a perimeter of length P. An electrical connection between the conductive one section and the circuit board point of lowest potential has a length less than one-half P.

22 Claims, 5 Drawing Sheets

300
320
322
317
350
SHEILD CAN
321
340a
319
310
REAR
315
FRONT OF PCB
340b
305
FRONT
355
310
300
REAR
320
322
SHEILD CAN
315
321
340b
318
PCB
305
FRONT
340a
335

400
420
457
419
422
410
REAR
440b
450
LCD
415
FRONT OF PCB
417
440a
LCD LENSE
405
FRONT
422
410
420
REAR
415
435
440b
418
PCB
FRONT
405
440a
300
400

557
500
520
522
519
510
REAR
517
537b
FRONT OF PCB
515
559
650
535b
537a
505
FRONT
535a
555

600
620
610
622
619
610
REAR
615
FRONT OF PCB
635b
617
605
FRONT
655
620
635a 522
520
510
REAR
515
PCB
570
518
537
535b
537b
505
FRONT
535
537a
535a
500

622
610
REAR
621
SHEILD CAN
615
PBC
618
635b
635
605
FRONT
635a
600

SYSTEM FOR INCREASING ANTENNA EFFICIENCY

BACKGROUND OF THE INVENTION

The present invention is directed toward a communications device, and more particularly toward increasing efficiency of an antenna for a communications device.

A communications device, for example a cellular telephone, typically includes a front section and a rear section, the front and rear sections acting as a housing for a circuit board. The circuit board includes the control circuitry for the cellular telephone. The cellular telephone further includes an antenna coupled to the circuit board used for transmitting and receiving information to and from a cellular base station. Cellular telephones are usually powered by a battery, the negative terminal of which is the lowest point of potential for the cellular telephone. When transmitting information from the cellular telephone to the cellular base station, battery power is consumed and therefore the operational availability of the device is shortened.

In a cellular telephone, one or both of the front and rear sections have in some cases been conductive, that is made of or coated with a conductive material. Where one or both of the sections are conductive, the conductive sections have sometimes been unconnected from the point of lowest potential, and in other cases have been connected to the point of lowest potential via a circuit board trace located around an entire perimeter of the circuit board. When the section(s) are conductive and connected to the point of lowest potential by the perimeter trace, the conductive sections serve as a ground plane for the antenna, aiding in the transmission and reception of information from and to the cellular telephone. However, antenna efficiency is not optimized. A less efficient cellular telephone antenna causes more battery power to be consumed when transmitting information to the cellular base station. Because battery power is limited, it is desirable to increase the efficiency of the antenna.

The present invention is directed to overcoming the problem discussed above.

SUMMARY OF THE INVENTION

In one aspect of the present invention, a communications device having an antenna includes a communication device housing having a front section and a rear section, wherein one of the front section and the rear section is conductive. A circuit board is mounted within the communications device body including a connection with a point of lowest potential for the communications device and having a perimeter of length P. An antenna is connected to the circuit board and is used for transmitting information from and receiving information to the communications device. An electrical connection electrically connects the conductive one of said front and rear sections to the circuit board point of lowest potential, where the electrical connection has a major dimension less than one-half P.

In various forms of this aspect of the invention, the electrical connection is located other than along the perimeter of the circuit board, and may comprise a plurality of contact locations. The electrical connection may be a capacitor or an inductor. The electrical connection may also have a major dimension of length less than one-tenth P. In another form, the antenna is mounted proximate an edge of the circuit board and the circuit board includes a ground plane coupled to the point of lowest potential and the electrical connection is positioned to cause a one-quarter wave waveguide trap to be formed between the one section and the ground plane, the one-quarter wave waveguide trap having a low current point proximate said edge. In another form, the communications device includes a negative power terminal, and the point of lowest potential is an electrical connection with the negative power terminal. In a further form, the electrical connection from the one section and the point of lowest potential is proximate to the negative power terminal.

In another form of this aspect, the one section may be metalized or may be formed from metal. In another form, where the other of the front section and the rear section is conductive, the communications device further comprises a second electrical connection between the other section and the point of lowest potential, where the second electrical connection has a length less than one-half P. In another form of this aspect, the other of the front section and the rear section is conductive, and the communications device further comprises a second electrical connection between the other section and the point of lowest potential substantially along the entire perimeter of the circuit board. In yet another form of this aspect, the other of the front section and the rear section is conductive and electrically unconnected from the point of lowest potential.

In another aspect of the invention, a communications device is provided including a communications device housing having a front section and a rear section, wherein one of the front section and the rear section is conductive. An antenna is mounted to the housing and is used for transmitting information from and receiving information to the communications device. A battery is mounted to the housing for powering the communications device where the battery includes a positive power terminal and a negative power terminal. A circuit board is mounted within the communications device housing and connected to the antenna and to the battery power jet terminals, where the circuit board has a perimeter of length P and includes a circuit board ground plane connected to the negative power terminal. An electrical connection electrically connects the conductive one of the front and rear sections to the circuit board ground plane, where the electrical connection has a major dimension less than ½P.

In various forms of this aspect of the present invention, the electrical connection may comprise a plurality of contact locations, and may be formed by a capacitor or an inductor. The electrical connection further may have a major dimension less than one-tenth P. In another form, the antenna is mounted proximate an edge of the circuit board and the circuit board includes a ground plane coupled to the point of lowest potential, and positioned to cause a one-quarter wave-guide trap to be formed between the one section and the ground plane, the one-quarter wave waveguide trap having a low current point proximate the edge. In another form where the other of the front section and the rear section is conductive, a second electrical connection is located between the other section and the circuit board ground plane, where the second electrical connection has a major dimension less than ½P.

DESCRIPTION OF THE PREFERRED EMBODIMENT

Figure 1:
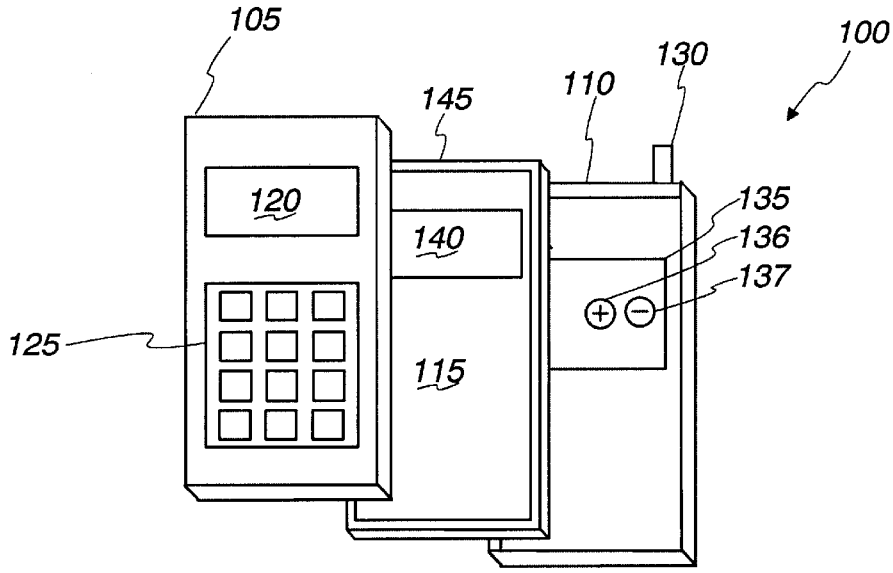
Fig. 1 (prior art)
FIG. 1 illustrates a communications device in accordance with the prior art.

FIG. 1 illustrates the electrical connection between a printed circuit board (PCB) and a housing of a mobile terminal such as a cellular telephone 100 in accordance with the prior art. The cellular telephone 100 includes the housing designated by a front section 105 and a rear section 110, and a PCB 115. The front section 105 includes an LCD lens 120 and a keypad 125. An antenna 130 is mounted to the rear section 110 for receiving and transmitting information to and from a cellular base station (not shown). A battery 135 with positive and negative power terminals 136, 137 respectively is also mounted to the rear section 110. The PCB 115 is connected to the power terminals 136, 137 and to the antenna 130. An LCD 140 is mounted on the PCB 115, such that when the cellular telephone 100 is assembled, the LCD 140 is viewable through the LCD lens 120. The PCB further includes a PCB trace 145 located along an entire perimeter P of the PCB 115, where the PCB trace 145 is connected to a cellular telephone point of lowest potential. Typically, the point of lowest potential is the negative power terminal 137. Although not shown, the PCB trace 145 may also be exposed on a back side of the PCB 115.

Where one or both of the front and rear sections 105 and 110 are conductive, the conductive section(s) have sometimes been unconnected from the point of lowest potential, and in other cases have been connected to the point of lowest potential along the entire perimeter P of the PCB 115 via the PCB trace 145. Where the conductive section(s) are connected to the point of lowest potential, the electrical connections are typically made using a conductive caulk, a conductive elastomer, or a conductive gasket along a perimeter of the respective front and rear section. When the cellular telephone 100 is assembled, the electrical connection connects the respective conductive section to the point of lowest potential along the entire perimeter P of the PCB 115 via the PCB trace 145.

Figure 2:
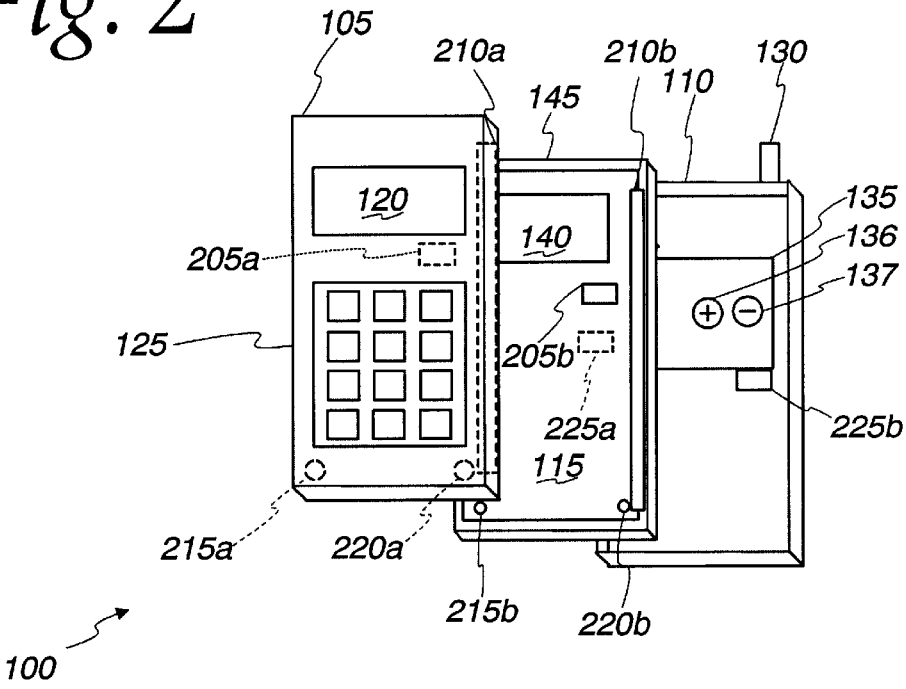
FIG. 2 illustrates a communications device embodying the present invention.

FIG. 2 illustrates a communications device embodying the present invention. Components of FIG. 2 identified by reference numerals identical to those of FIG. 1 are the same and will not be discussed in detail.

In one form of the FIG. 2 embodiment, the front section 105 is conductive, that is formed from metal, formed from a conductive material such as a conductive plastic, or coated with a conductive material along an inner surface of the front section 105. The front section 105 is unconnected from the point of lowest potential, for example the negative battery terminal 137 or some terminal connected thereto, except for an electrical connection between positions designated as 205*a* and 205*b,* where 205*b* is further connected to the point of lowest potential 137.

In another form of the FIG. 2 embodiment, where the front section 105 is conductive, the front section 105 is unconnected from the point of lowest potential 137 except for an electrical connection between an entire side 210*a* of the front section 105 designated by area 210*a* and a side of the PCB 115 along, for example, the portion of the PCB trace 145 designated within the area 210*b*.

In yet another form, where the front section 105 is conductive, the front section 105 is unconnected from the point of lowest potential 137 except for two (2) electrical connections coupling the front section 105 to the point of lowest potential 137. For example, electrical connections extending between positions 215*a* and 215*b* and positions 220*a* and 220*b* electrically couple the front section 105 to the point of lowest potential 137, where the electrical connections 215*b* and 220*b* are connected to the point of lowest potential 137.

In other forms the rear section 110 is conductive, and is unconnected from the point of lowest potential except for an electrical connection between a position 225*a* located on a back of the PCB 115, and a position 225*b,* where the position 225*a* is connected to the point of lowest potential 137.

In additional forms (not shown), both the front and rear sections 105 and 110 are conductive and one of the front and rear sections is connected to the point of lowest potential 137 with the electrical connection having a major dimension less than ½P. The other of the front and rear sections is coupled to the point of lowest potential by a second electrical connection having a major dimension less then ½P, or via an electrical connection around the entire perimeter P of the circuit board via the PCB trace 145.

For the embodiments just described, the electrical connection from the respective conductive section to the point of lowest potential, having a major dimension less than one-half the perimeter of the PCB 115, increases the antenna efficiency of the antenna 130. Increasing antenna efficiency allows the cellular telephone to transmit a signal having the same strength as a cellular telephone utilizing prior art electrical connection techniques between the conductive section(s) and the point of lowest potential, while consuming less battery power. Alternatively, the electrical connections utilized in the embodiment just described allow a greater signal strength to be transmitted from the cellular telephone over that of the prior art, while consuming the same battery power as the cellular telephone utilizing prior art electrical connections between the conductive section(s) and the point of lowest potential.

The electrical connections may be formed using wire, conductive foam, conductive elastomer, conductive gasket material, or any other material sufficient for forming an adequate electrical ground.

The size of the electrical connection is not vital so long as it is sufficient (large enough) to form an adequate ground, and has a major dimension less than one-halfP. A minimum size for an electrical connection to form an adequate electrical ground is known to one skilled in the art. A typical thickness for the electrical connection ranges from a width of a wire, or conductive sheet of approximately 1 mm width, to a width of a circular bead of conductive material (for example conductive foam or gasket) of approximately 6 mm diameter. The width of the electrical connection may be less so long as an adequate electrical ground is formed, and the width may be greater where placement of components in the communications device or other manufacturing considerations allow. The height of the electrical connection is typically that of a distance between the respective positions between which the electrical connection is made when the front section 105, the rear section 110 and the PCB 115 are assembled together. One skilled in the art will realize that the height of the electrical connection may be greater, especially for example, where the electrical connection is formed from a compressible material such as a conductive foam or gasket, or from a conductive material having spring-like properties. In addition, the electrical connection may be formed using an inductor or a capacitor, further discussed below.

When determining the position for the electrical connection between the respective conductive section and the point of lowest potential, it is preferable to select a position proximate the negative battery terminal 137. However, due to manufacturing considerations or placement of certain components on the respective conductive section or the PCB, the preferred position may not always be achieved. For example, if it is desired to connect a conductive front section 105 to the point of lowest potential, and the negative battery terminal 137 is positioned directly beneath the LCD 140 and the LCD lens 120, a connection between the front section 105 and the PCB 115 could not be achieved directly above the negative battery terminal 137. In such situations, the position of the electrical connection is selected such that the point of contact between the front section 105 and the PCB 115 are close to but not directly above the negative battery terminal 137.

Although it is preferable that the electrical connection be proximate the negative battery terminal, improved antenna performance is also achieved where the electrical connection is not proximate the negative battery terminal.

Figures 3A, 3B, 4A, 4B:
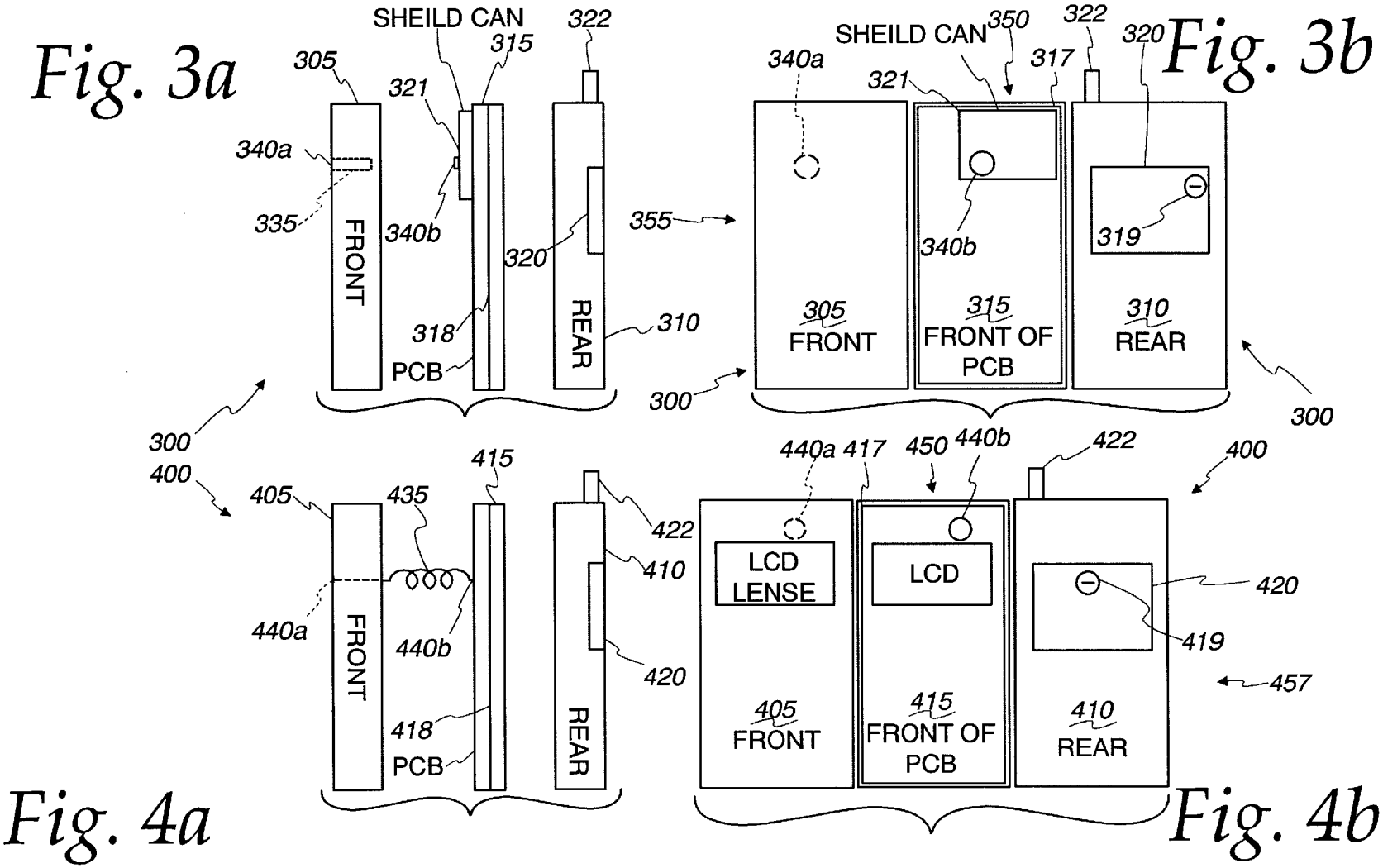
FIGS. 3*a* and 3*b* are an exploded side view and side by side sections, respectively, of a communications device in accordance with one embodiment of the present invention.
FIGS. 4*a* and 4*b* are an exploded side view and side by side sections, respectively, of a communications device in accordance with another embodiment of the present invention.

FIGS. 3*a* and 3*b* are exploded side and side by side section views, respectively, of an Ericsson cellular telephone 300, model #A1228d, in accordance with an embodiment of the present invention. A front section 305, a rear section 310, and a PCB 315 are shown. The PCB 315 includes a PCB trace 317 exposed on a front and a back of the PCB 315 along the perimeter of the PCB. The PCB trace 317 is connected to a PCB ground plane 318 which is connected to the point of lowest potential for the cellular telephone, typically a negative power terminal 319 of a battery 320. The PCB 315 further includes a shield can 321 which is connected to the PCB ground plane 318. The shield can is conductive, and is typically used for electrostatic discharge protection, and/or to reduce emissions from the cellular telephone. The PCB is connected to an antenna 322, used for receiving and transmitting information to and from the cellular telephone. Both the front and rear section 305 and 310 are metalized, that is coated with a conductive material. The rear section 310 is connected to the PCB ground plane around an entire perimeter P of the PCB 315 via the PCB trace 317. The front section 305 is isolated from the PCB ground plane except for an electrical connection 335 which extends between a position 340*a* on the front section 305, and a position 340*b* located on the shield can 321. Positions 340*a* and 340*b* are located approximately 21 mm from a top of the cellular telephone 300, designated generally by arrow 350, and approximately 11 mm from a left side of the cellular telephone 300, designated generally by an arrow 355. The electrical connection 335 is formed from a conductive elastomer having a substantially circular configuration of approximately 3 mm diameter. The elastomer is of sufficient height such that when the PCB 315 is assembled within the front section 305, the electrical connection 335 contacts both the front section 305 and the shield can 320. Electrically connecting the front section 305 to the point of lowest potential in this manner improves antenna efficiency of the antenna 322 by approximately 65%.

FIGS. 4*a* and 4*b* are exploded side and side by side views, respectively, of an Ericsson cellular telephone 400, model #T28s, in accordance with another embodiment of the present invention. A front section 405, a rear section 410, and a PCB 415 are shown. The PCB 415 includes a PCB trace 417 exposed on a front and a back of the PCB 415 along the perimeter of the PCB. The PCB trace 417 is connected to a PCB ground plane 418 which is connected to the point of lowest potential for the cellular telephone, typically a negative power terminal 419 of a battery 420. The PCB 415 is electrically connected to an antenna 422. Both the front and rear sections 405 and 410 are conductive, where the front section 405 is metalized, and the rear section 410 is made of metal. The rear section 410 is connected to the PCB ground plane 418 around the entire perimeter P of the PCB 415 via the PCB trace 417. The front section 405 is isolated from the PCB ground plane except for an electrical connection 435 which extends between a position 440*a* on the front section 405, and a position 440*b* located on the PCB 415. The positions 440*a* and 440*b* are located approximately 20 mm from a top of the cellular telephone 400 designated generally by an arrow 450, and approximately 24 mm from a right side of the cellular telephone designated generally by an arrow 457. The electrical connection 435 is formed from an inductor. The inductor may have from 2 to 6 turns, such as 3.5 to 4 turns. The inductor has an air core with a diameter of approximately 4 mm. Electrically connecting the front section 405 to the point of lowest potential 419 in this manner improves antenna efficiency of the antenna 422 by approximately 65%.

Figures 5A, 5B, 6A, 6B:
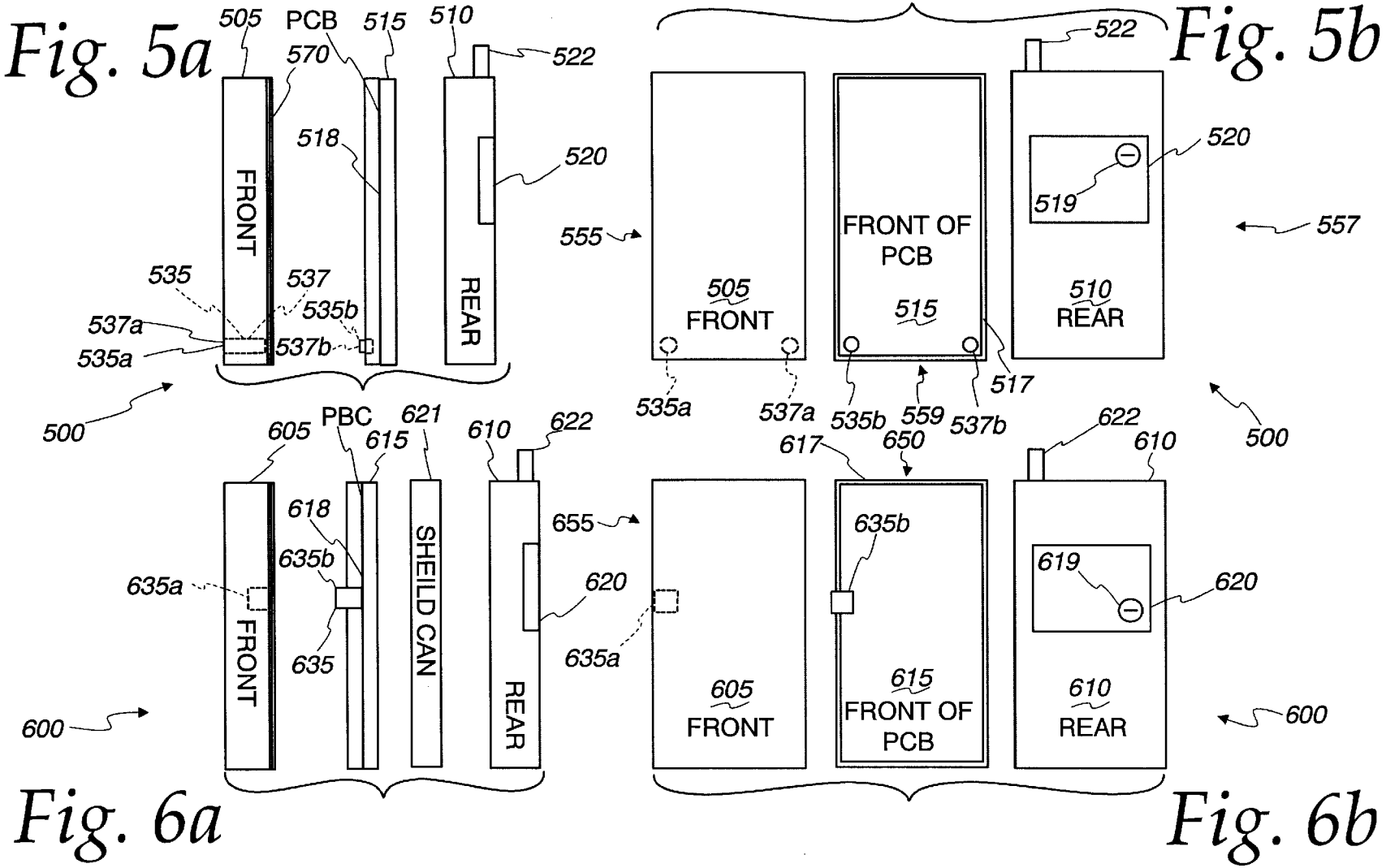
FIGS. 5*a* and 5*b* are an exploded side view and side by side sections, respectively, of a communications device in accordance with still another embodiment of the present invention.
FIGS. 6*a* and 6*b* are an exploded side view and side by side sections, respectively, of a communications device in accordance with yet another embodiment of the present invention.

FIGS. 5*a* and 5*b* are exploded side and side by side views, respectively, of an Ericsson cellular telephone 500, model #KH668, in accordance with an embodiment of the present invention. A front section 505, a rear section 510, and a PCB 515 are shown. The PCB 515 includes a PCB trace 517 exposed on a front and a back of the PCB 515 along a perimeter of the PCB. The PCB trace 517 is connected to a PCB ground plane 518 which is coupled to the point of lowest potential for the cellular telephone 500, typically a negative power terminal 519 of a battery 520. The PCB 515 is electrically connected to an antenna 522. The front section 505 is metalized, and the rear section 510 is made of metal. The rear section 510 is connected to the PCB point of lowest potential around the entire perimeter P of the PCB 515 via PCB trace 517. The front section 505 is isolated from the PCB point of lowest potential except for two electrical connections 535 and 537. One electrical connection 535 extends between a position 535*a* located on the front section 505 and a position 535*b* which is located on the front of the PCB 515. The other electrical connection 537 extends between a position 537*a* located on the front section 505 and a position 537*b* located on the front of the PCB 515. The positions 535*b* and 537*b* are coupled to the point of lowest potential for the cellular telephone 500, for example, via the PCB trace 517. Positions 535*a* and 535*b* are located approximately 6 mm from a left side of the cellular telephone 500 designated generally by an arrow 555, and approximately 6 mm from a bottom of the cellular telephone designated generally by an arrow 559. Positions 537*a* and 537*b* are located approximately 6 mm from a right side of the cellular telephone 500 designated generally by an arrow 557, and approximately 6 mm from the bottom designated at 559. Here, the electrical connections 535 and 537 are formed from respective screw bosses approximately 5 mm in diameter, which electrically connect the front section 505 to the PCB 515 when the front section and the PCB are assembled. Electrically connecting the front section 505 to the point of lowest potential 519 in this manner improves antenna efficiency of the antenna 522 by approximately 20%.

In the embodiments discussed above, it is common that a conductive section is connected to the point of lowest potential via an electrical connection having a length less than one-half the perimeter of the PCB, or is completely unconnected from the point of lowest potential. In such circumstances, it may be necessary to remove a portion of the metalized coating on the conductive section, or to insulate a portion of the conductive section from the point of lowest potential to ensure that a complete contact between the respective conductive section and the point of lowest potential is not made. For example, referring to FIG. 5*a,* a portion around a perimeter of the front section 505, designated in the area 570, is not metalized with the rest of the front section 505, to ensure that when the PCB 515 is assembled with the front section 505, the front section 505 is not connected to the point of lowest potential along the entire perimeter of the front section 505 via the PCB trace 517. Alternatively, the entire front section 505 may be metalized, with an insulating material placed around the perimeter of the front section 505 to ensure that the front section 505 does not contact the point, of lowest potential around the entire perimeter of the front section via the PCB trace 517.

FIGS. 6*a* and 6*b* are exploded side and side by side views, respectively, of an Ericsson cellular telephone 600, model #A2218d, in accordance with another embodiment of the present invention. A front section 605, a rear section 610, and a PCB 615 are shown. The PCB 615 includes a PCB trace 617 exposed on a front and a back of the PCB 615 extending along a perimeter of the PCB. The PCB trace 617 is connected to a PCB ground plane 618 which is coupled to a point of lowest potential for the cellular telephone 600, typically a negative power terminal 619 of a battery 620. A shield can 621 is formed from metalized plastic and is coupled to the back of the PCB 615 via the PCB trace 617. The PCB 615 is further coupled to an antenna 622. The front section 605 is metalized, and the rear section 610 is made of plastic. The shield can 621 is connected to the point of lowest potential around the entire perimeter P of the PCB 615 via the PCB trace 617. The front section 605 is unconnected from the point of lowest potential except for an electrical connection 635 which extends between a position 635*a* on the front section 605, and a position 635*b* located on the front and side of the PCB 615. The electrical connection 635 and the corresponding position 635*a* and 635*b* are located along a left side of the cellular telephone 600, generally designated by an arrow 655, approximately 77 mm from a top of the cellular telephone, generally designated by an arrow 650. The electrical connection 635 is formed from a conductive elastomer of approximately 4 mm width and 5 mm length, such that when the front section 605 and the PCB 615 are assembled, the front section 605 is coupled to the point of lowest potential. Electrically connecting the front section 605 to the point of lowest potential 625 in this manner improves antenna efficiency by approximately 50%.

In an alternate embodiment (not shown), the electrical connection 635 and respective positions 635*a* and 635*b* are located on a right side of the cellular telephone 600 approximately 77 mm from the top 650.

Figure 7B:
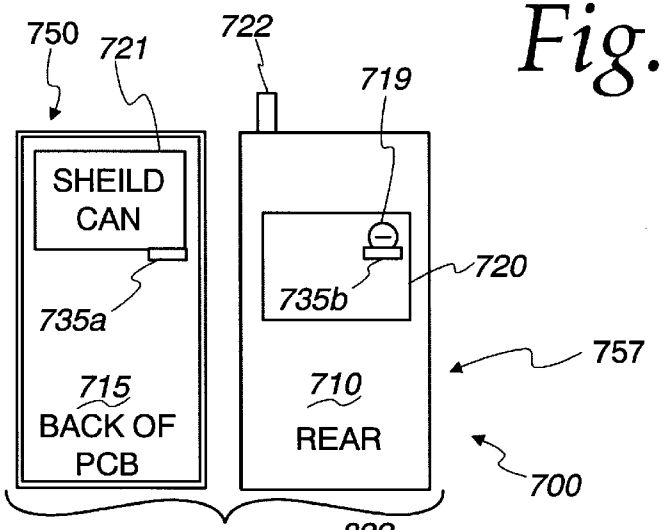
FIGS. 7*a* and 7*b* are an exploded side view and side by side sections, respectively, of a communications device in accordance with still another embodiment of the present invention.
Figure 7A:
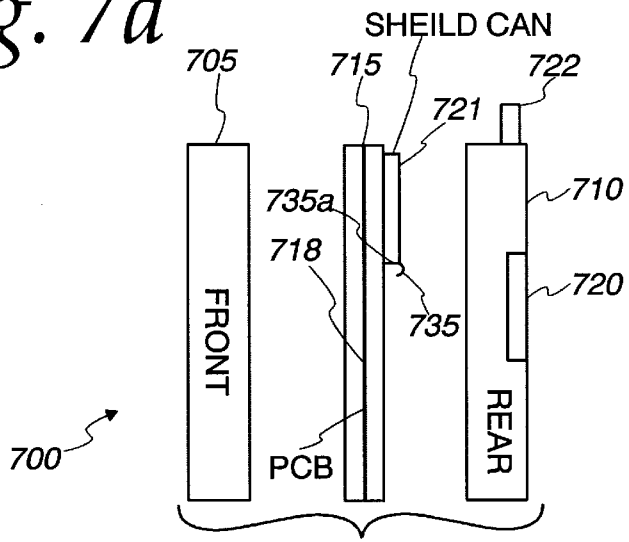

FIGS. 7*a* and 7*b* are exploded side and side by side views, respectively, of an Ericsson cellular telephone 700, model #KF788, according to another embodiment of the present invention. A front section 705, a rear section 710 and a PCB 715 are shown. The PCB 715 includes a PCB ground plane 718 which is connected to the point of lowest potential for the cellular telephone 700, typically a negative power terminal 719 of a battery 720. The PCB 715 further includes a shield can 721 which is coupled to the PCB ground plane. The PCB 715 is electrically connected to an antenna 722. Both the front and rear sections 705 and 710 are metalized. The front section 705 is isolated from the point of lowest potential. The rear section 710 is isolated from the point of lowest potential except for an electrical connection 735 extending between a position 735*a* located on the shield can 721, and a position 735*b* located on the rear section 710. The positions 735*a* and 735*b* are located approximately 41 mm from a top of the cellular telephone 700 designated generally by an arrow 750, and approximately 1 mm from a right side of the cellular telephone 700 designated generally by an arrow 757.

Figure 7C:
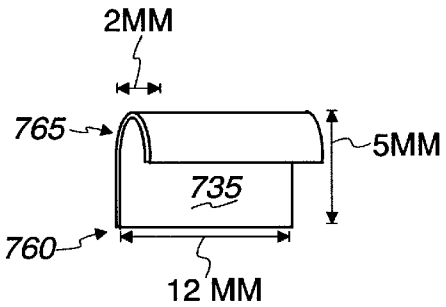
FIG. 7*c* illustrates the electrical connection utilized in the embodiment of FIGS. 7*a* and 7*b;*

FIG. 7*c* further illustrates the electrical connection 735, which may be formed from a sheet of metal bent in a "J" configuration. The electrical connection 735 has a height of approximately 5 mm, a length of approximately 12 mm, and a curved portion designated generally at 760 having a diameter of approximately 2 mm. In an alternate embodiment, the length of the electrical connection 735 may be approximately 1 cm.

A bottom portion 760 of the electrical connection 735 is installed in a battery clip for the negative power terminal 719 and makes contact with metalized rear housing 710, and a top portion of the electrical connector 735 designated at the curved section 765 makes contact with the shield can 721. Electrically connecting the rear section 710 to the point of lowest potential in this manner improves antenna efficiency by approximately 40%.

Figure 8:
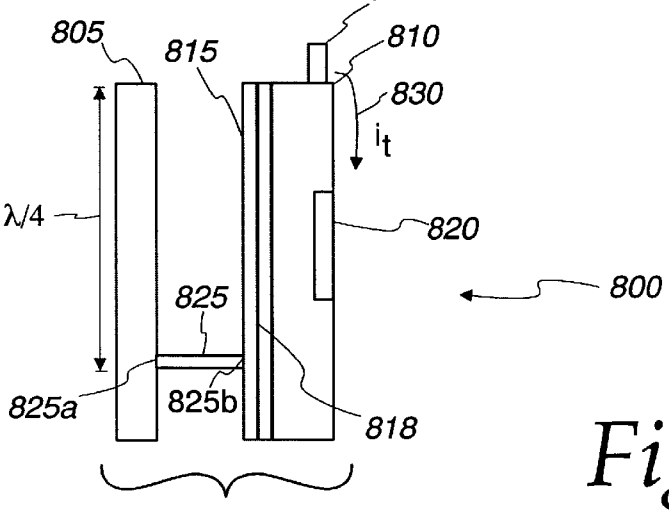
FIG. 8 is an exploded side view of a communications device in accordance with an embodiment of the present invention.
Figure 10:
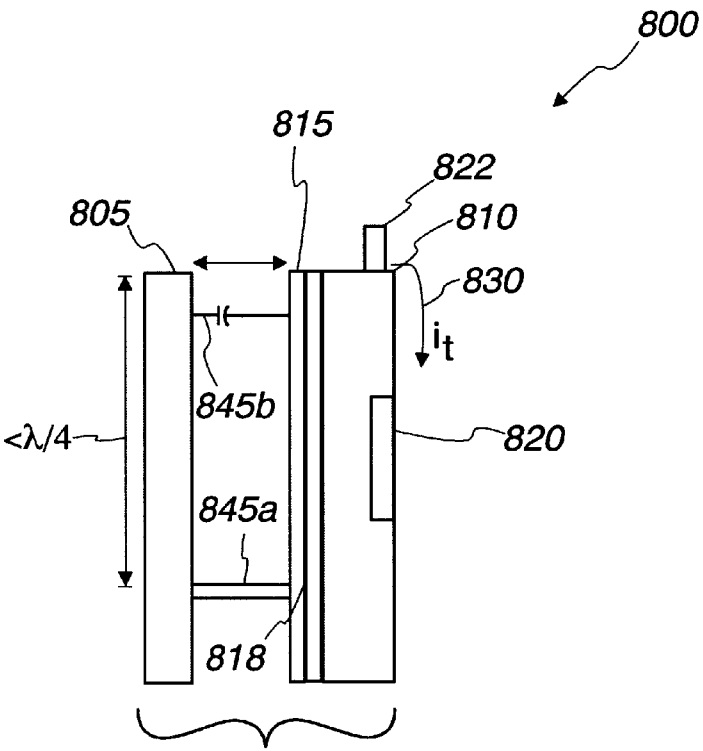
FIG. 10 is an exploded side view of a communications device in accordance with still another embodiment of the present invention.
Figure 9:
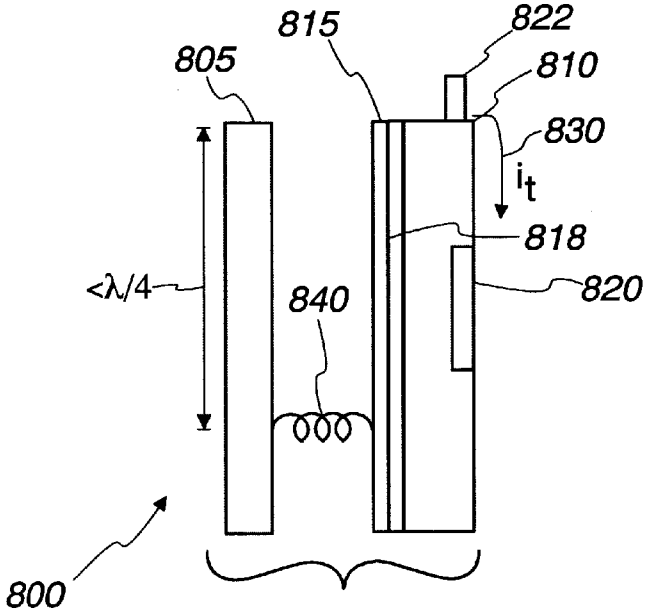
FIG. 9 is an exploded side view of a communications device in accordance with another embodiment of the present invention.

In at least the embodiments discussed above where the front section is coupled to the point of lowest potential via an electrical connection having a length less than one-half the perimeter of the PCB, it is believed that the electrical connection between the front section and the PCB causes a quarter wave, wave guide trap to be formed between the front section and the PCB, as described with respect to FIGS. 8–10.

FIGS. 8–10 are exploded side views of a cellular telephone in accordance with embodiments of the present invention. FIGS. 8–10 show a front section 805, a rear section 810, and a PCB 815. The PCB 815 includes a ground plane 818 which is connected to the cellular telephone 800 point of lowest potential, typically a negative power terminal (not shown) of a battery 820. The PCB further includes a PCB trace (not shown) exposed on a front and a back of the PCB, similar to the PCB traces of FIGS. 3*b,* 4*b,* 5*b* and 6*b* extending around a complete perimeter of the PCB, and connected to the PCB ground plane 818. The rear section 810 is connected to the PCB 815 around the entire perimeter P of the PCB 815 via the PCB trace. An antenna 822 is coupled to the PCB 815 used for receiving and transmitting information to/from the cellular telephone.

In FIG. 8, an electrical connection 825 is formed between position 825*a* on the front section 805 and position 825*b* located on the PCB 815. Position 825*b* is further coupled to the PCB ground plane 818. The electrical connection is positioned approximately λ/4 from a top of the front section 805 and PCB 815 such that a quarter wave, wave guide trap is formed between the front section and the PCB 815, with a low current point (or high impedance Z) near the antenna 822. This presents a very high impedance to the normal current path down the front of the telephone, causing the ground currents $i_t$ to flow down the rear section 810 of the cellular telephone as designated by an arrow 830. The ground currents $i_t$ are not restricted from flowing down the sides and the rear section of the cellular telephone 800, so a necessary antenna ground plane for the antenna 822 may be realized within the cellular telephone 800. The length of the quarter wave trap will be somewhat shorter than a free space quarter wave length due to dielectric loading between the conductive front section 805 and conductive rear section 810 and PCB 815. The connection 825 in FIG. 8 may be formed from a wire, or a conductive elastomer or gasket as discussed above.

FIG. 9 illustrates use of inductive loading to significantly shorten the length of the quarter-wave wave guide trap between the front section 805 and the PCB 815. Here, the electrical connection 840 is an inductor providing inductive loading. The inductive loading provided by the inductor 840 is advantageous as it is not always possible to locate the electrical connection between the front section 805 and the PCB 815 at the λ/4 distance from the top of the front section 805 and PCB 815 because of, for example, location of a cellular telephone LCD or a cellular telephone keypad, or due to other manufacturing considerations.

FIG. 10 illustrates utilization of capacitive loading to shorten the length of the quarter wave, wave guide trap. Shortening the length of the quarter wave wave-guide trap using a capacitor is advantageous as it is not always possible to locate the electrical connection between the front section 805 and the PCB 815 at the λ/4 distance because of components on the front section 805 and PCB 815, or because of other manufacturing considerations. Here, the electrical connection includes an electrical connection 845*a* similar to the electrical connection 825 discussed above with respect to FIG. 8 and an electrical connection 845*b* formed by a capacitor. The value of the capacitor and position of both the electrical connections 845*a* and 845*b* may be determined experimentally to achieve the advantages of the present invention, as would be realized by one skilled in the art.

Although the present invention has been discussed in the context of a cellular telephone, one skilled in the art would realize that the advantages gained therefrom would be realized in any communications device.

Still other aspects and advantages of the present invention can be obtained from a study of the specification, the drawings, and the appended claims. It should be understood, however, that the present invention could be used in alternate forms where less than all of the advantages of the present invention and preferred embodiments as described above would be obtained.

We claim:

1. A communications device, comprising:

a communications device housing having a front section and a rear section, wherein one of the front section and the rear section is conductive;

an antenna for transmitting information from and receiving information to the communications device;

a circuit board mounted within the communications device housing, where the circuit board has a perimeter of length P, is electrically connected to the antenna, and includes a point of lowest potential for the communications device; and an electrical connection electrically connecting said conductive one of said front and rear sections to said circuit board point of lowest potential, said electrical connection having a major dimension less than ½P.

2. The communications device of claim 1 wherein the electrical connection is located other than along the perimeter of the circuit board.

3. The communications device of claim 1 wherein the electrical connection comprises a plurality of contact locations.

4. The communications device of claim 1 wherein the antenna is mounted proximate an edge of the circuit board and the circuit board includes a ground plane coupled to the point of lowest potential, and the electrical connection is positioned to cause a ¼ wave waveguide trap to be formed between said conductive one of said front and rear sections and the ground plane, the ¼ wave waveguide trap having a low current point proximate said edge.

5. The communications device of claim 1 wherein the electrical connection is an inductor.

6. The communications device of claim 1 wherein the communications device includes a negative power terminal, and the point of lowest potential is the negative power terminal.

7. The communications device of claim 6 wherein the electrical connection from said conductive one of said front and rear sections and the point of lowest potential is proximate to the negative power terminal.

8. The communications device of claim 1 wherein the communications device is a cellular telephone.

9. The communications device of claim 1 wherein the electrical connection has a major dimension less than one-tenth P.

10. The communications device of claim 1 wherein said conductive one of said front and rear sections includes a metalized coating deposited thereon.

11. The communications device of claim 1 wherein said conductive one of said front and rear sections is metal.

12. The communications device of claim 1 wherein the electrical connection is a capacitor.

13. The communications device of claim 1 wherein the other of the front section and the rear section is conductive, and further comprising a second electrical connection between said other section and said point of lowest potential, said second electrical connection having a length less than ½P.

14. The communications device of claim 1 wherein the other of the front section and the rear section is conductive, and further comprising a second electrical connection between said other section and said point of lowest potential substantially along the entire perimeter of the circuit board.

15. The communications device of claim 1 wherein the other of the front section and the rear section is conductive but not connected to the point of lowest potential.

16. A communications device, comprising:

a communications device housing having a front section and rear section, wherein one of the front section and the rear section is conductive;

an antenna mounted to the housing for transmitting information from and receiving information to the communications device;

a battery mounted to the housing for powering the communications device and including a positive power terminal and a negative power terminal;

a circuit board mounted within the communications device housing and connected to the antenna and to the battery power terminals, the circuit board having a perimeter of length P and including a circuit board ground plane connected to the negative power terminal; and an electrical connection electrically connecting said conductive one of the front and rear sections to the circuit board ground plane, said electrical connection having a major dimension less than ½P.

17. The communications device of claim 16 wherein the electrical connection comprises a plurality of contact locations.

18. The communications device of claim 16 wherein the antenna is mounted proximate an edge of the circuit board and the circuit board includes a ground plane coupled to the point of lowest potential, and positioned to cause a ¼ wave wave-guide trap to be formed between said one section and the ground plane, the ¼ wave waveguide trap having a low current point proximate said edge.

19. The communications device of claim 16 wherein the electrical connection is an inductor.

20. The communications device of claim 16 wherein the electrical connection is a capacitor.

21. The communications device of claim 16 wherein the other of the front section and the rear section is conductive, and further comprising a second electrical connection between said other section and said circuit board ground plane, said second electrical connection having a major dimension less than ½P.

22. The communications device of claim 16 wherein the electrical connection has a major dimension less than one-tenth P.

* * * * *